US005873207A

United States Patent [19]

Bertels

[11] Patent Number: 5,873,207

[45] Date of Patent: Feb. 23, 1999

[54] COUPLING BETWEEN TWO STRUCTURAL ELEMENTS AND SPATIAL STRUCTURE WITH SUCH COUPLINGS

[76] Inventor: Augustinus Wilhelmus Maria Bertels, Utrechtseweg 437, NL-6865 CL Doorwerth, Netherlands

[21] Appl. No.: 860,949

[22] PCT Filed: Jan. 11, 1996

[86] PCT No.: PCT/NL96/00023

§ 371 Date: Sep. 17, 1997

§ 102(e) Date: Sep. 17, 1997

[87] PCT Pub. No.: WO96/21781

PCT Pub. Date: Jul. 18, 1996

[30] Foreign Application Priority Data

Jan. 13, 1995 [NL] Netherlands ..... 9500072

[51] Int. Cl.[6] ..... E04B 1/00

[52] U.S. Cl. ..... 52/259; 52/250

[58] Field of Search ..... 52/633, 660, 663, 52/664, 665, 667, 668, 676, 250, 251, 259

[56] References Cited

U.S. PATENT DOCUMENTS

| | | | |
|---|---|---|---|
| 3,881,289 | 5/1975 | Mauroner | 52/259 |
| 4,040,220 | 8/1977 | Henager | 52/259 |
| 4,128,980 | 12/1978 | Abdallah | 52/259 X |
| 5,163,263 | 11/1992 | De Schutter et al. | 52/259 X |
| 5,335,472 | 8/1994 | Phillips | 52/259 X |

FOREIGN PATENT DOCUMENTS

| | | |
|---|---|---|
| 0136283 | 4/1985 | European Pat. Off. . |
| 1341305 | 1/1964 | France . |
| 3513235 | 10/1985 | Germany . |

*Primary Examiner*—Creighton Smith

*Attorney, Agent, or Firm*—Webb Ziesenheim Bruening Logsdon Orkin & Hanson, P.C.

[57] ABSTRACT

A coupling is provided between two structural elements, each comprising at least one part having tensively strong gauze formed for instance of metal such as steel, which parts can be registered in interlaced relation and which can be mutually coupled in this interlaced and registered situation by an elongate coupling element. A very practical embodiment is that in which the one part has at least two hook-like or loop-like protrusions which can be placed through the other part, wherein the elongate coupling element can be placed through these protrusions to thus block rearward displacement.

20 Claims, 12 Drawing Sheets

COUPLING BETWEEN TWO STRUCTURAL ELEMENTS AND SPATIAL STRUCTURE WITH SUCH COUPLINGS

BACKGROUND OF THE INVENTION

The invention relates to the coupling between two structural elements.

In order to build spatial constructions, in particular with reinforced concrete, use is made of a reinforcement consisting of mutually coupled elongate concrete reinforcing rods which are brought into the correct shape on site and subsequently enclosed in a shuttering with concrete in order to be embedded therein.

Examples of spatial constructions include walls, buildings, and catch pits.

The invention generally proposes as its object to provide a coupling between two structural elements such that it can be prepared in advance in the factory and such that on site the coupling can be realized in the most simple and rapid manner.

SUMMARY OF THE INVENTION

In this respect the invention generally provides a coupling between two structural elements, each comprising at least one part having tensively strong gauze, formed for instance of metal such as steel, which parts can be registered in interlaced relation and which can be mutually coupled in this interlaced and registered situation by means of an elongate coupling element.

A very practical embodiment is that in which the one part has at least two hook-like or loop-like protrusions which can be placed through the other part, wherein the elongate coupling element can be placed through these protrusions to thus block rearward displacement.

Attention is drawn to the fact that the elongate element can in principle have any suitable form, provided the requirement is met that it is suitable for blocking rearward displacement. The use of more than one elongate element is also possible.

A coupling is recommended in which the elongate element is straight Particularly in the case where a series of registered protrusions is applied, a straight element can be arranged very quickly.

A specific embodiment is that in which each structural element is comprised almost entirely of gauze.

Any suitable material can in principle be envisaged for the gauze. The possibility of concrete reinforcing rods is already mentioned above. Such reinforcing rods are very suitable for arrangement as reinforcement in concrete. For other applications use can also be made of steel. Use can also be made of for instance glass fabric or fibre-reinforced polymers.

The invention further relates to a spatial structure comprising a plurality of structural elements mutually connected by means of couplings of the above specified type according to the invention.

BRIEF DESCRIPTION OF THE DRAWINGS

The invention will now be elucidated with reference to the annexed drawings. Herein.

DESCRIPTION OF THE PREFERRED EMBODIMENTS

Figure 1:
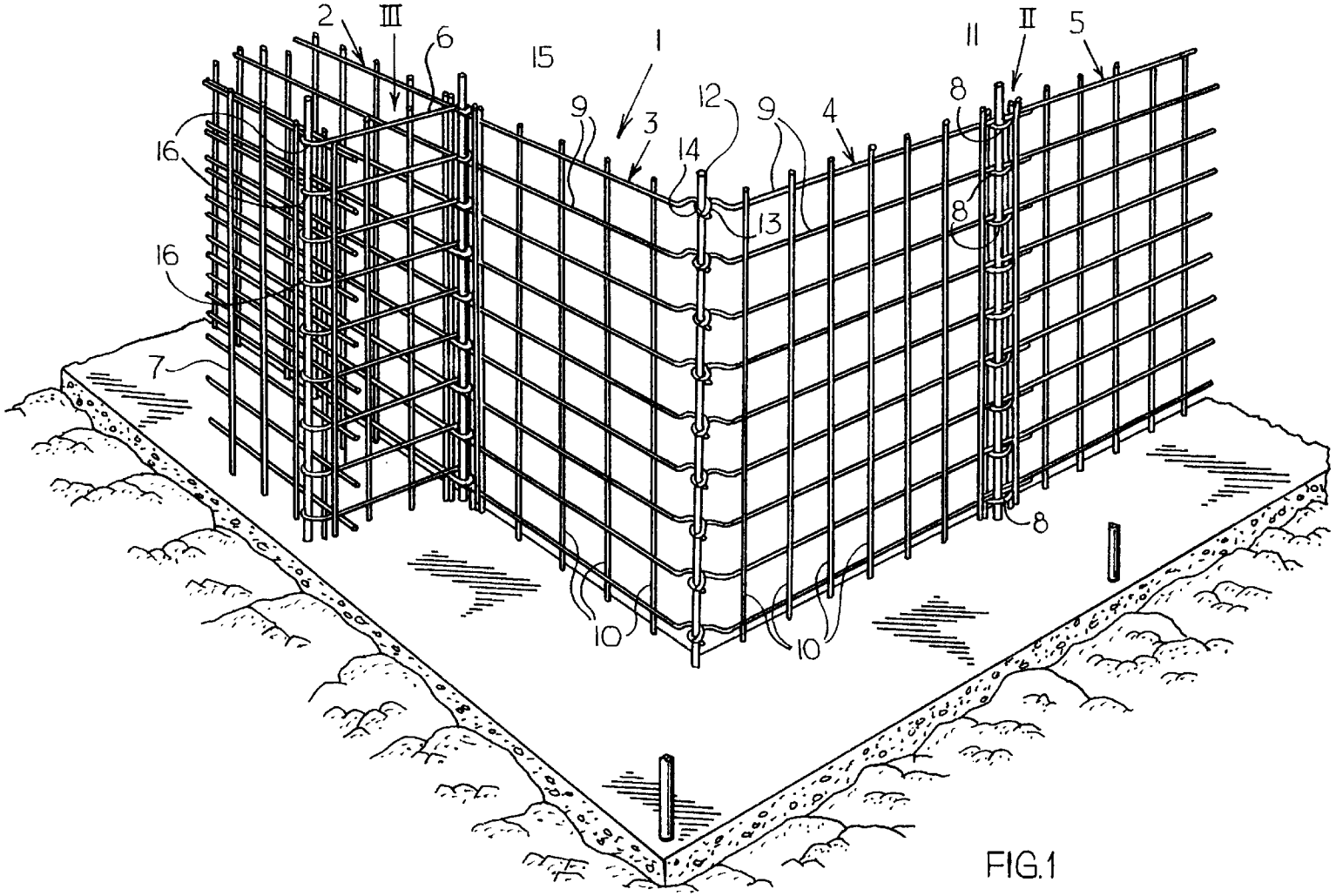
FIG. 1 shows a perspective view of a part of a spatial structure with gauze meshes connected by means of couplings according to the invention.

FIG. 1 shows a spatial structure 1 with a plurality of gauze meshes 2, 3, 4, 5, 6, 7.

Each gauze mesh comprises a plurality of horizontal rods and a plurality of vertical rods which are ordered in grid form and are welded to each other at the junctions.

Figure 2:
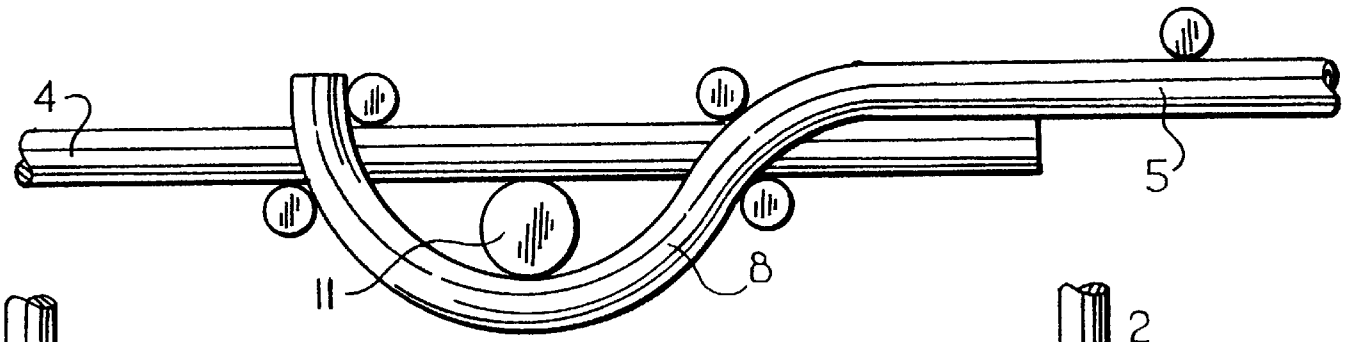
FIG. 2 shows on enlarged scale the detail II according to FIG. 1 in top view.

As show in FIG. 2, the gauze mesh 5 has on its side facing toward gauze mesh 4 a series of hook-like protrusions located in register one above another and all designated with 8. These protrusions are inserted into the interspaces between the horizontal rods 9 and the last two vertical rods 10 of gauze mesh 4 as shown in FIG. 1. Through the hook-like protrusions 8 is then placed a pin 11 which blocks rearward displacement and thus mutually couples the gauze meshes 4 and 5.

The gauze meshes 2 and 3 are coupled in the same manner.

The coupling of gauze meshes 3 and 4 is effected by inserting a pin 12 into the respective hook-like protrusions 13, 14 on the meshes 3, 4 respectively.

Figure 3:
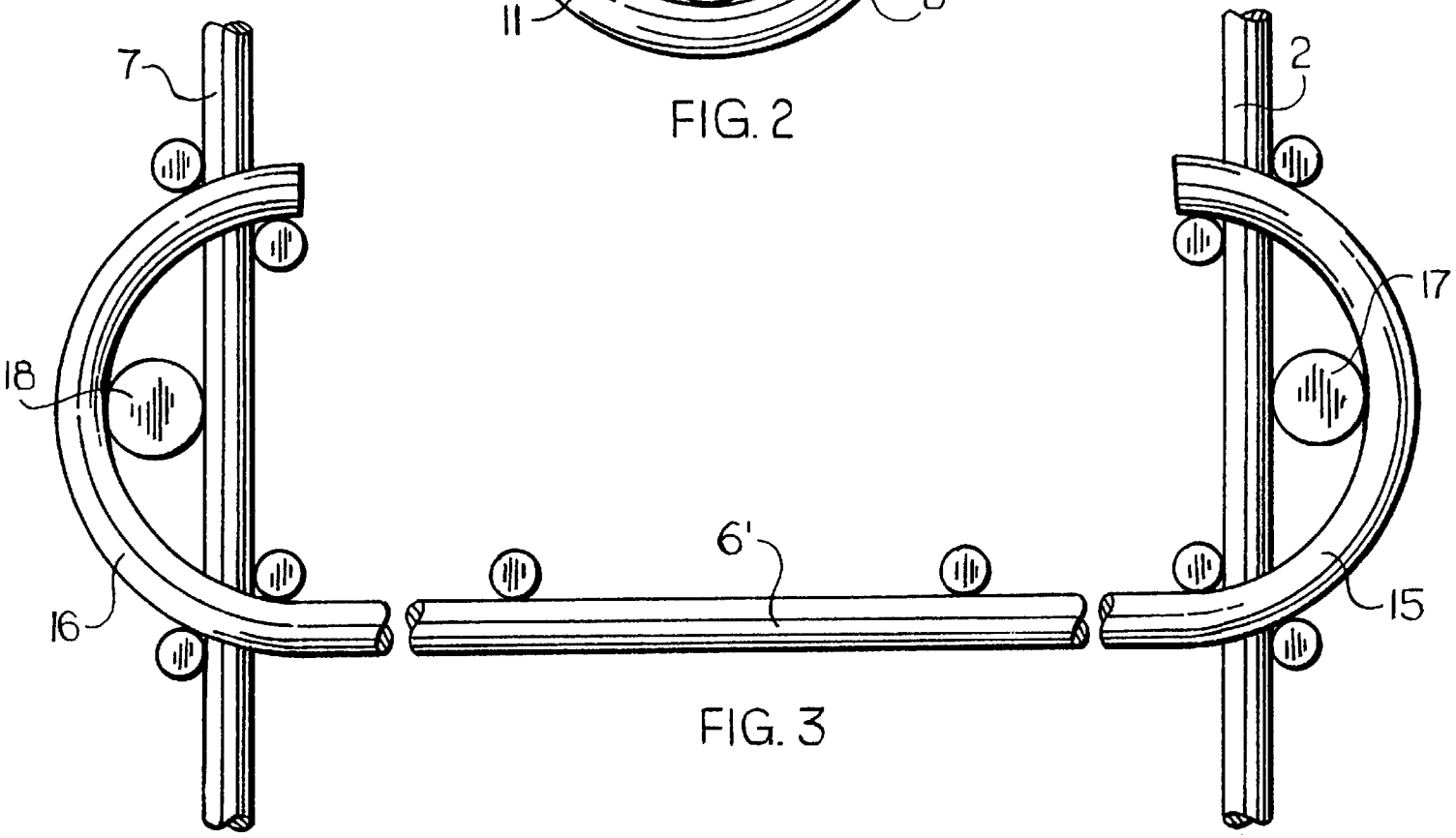
FIG. 3 is a view corresponding with FIG. 2 of the detail III of FIG. 1 in another embodiment.

FIG. 3 shows a variant of the coupling shown in FIG. 1 between the gauze meshes 2, 6 and 7. The gauze mesh 6' shown in FIG. 3 has on its ends hook-like protrusions 15, 16 which can co-act in the same manner as hooks 8 with a gauze mesh which can be placed in register therewith. In the manner shown in FIG. 3 pins 17, 18 are inserted for this purpose into the row of hooks respectively 15, 16 placed one above another. The gauze mesh 6 according to FIG. 1 differs from gauze mesh 6' of FIG. 3 in the sense that the direction of the hooks 15 is reversed.

Attention is drawn to the fact that gauze meshes can also be provided with protrusions extending on either side.

A comparatively small gauze mesh can also be placed with two or more larger gauze meshes placed in overlapping manner or in adjacent relationship in order thus to function as coupling gauze mesh. Use is then also made here of an elongate coupling elements wherein in this case more than two structural elements are mutually connected.

Figure 4:
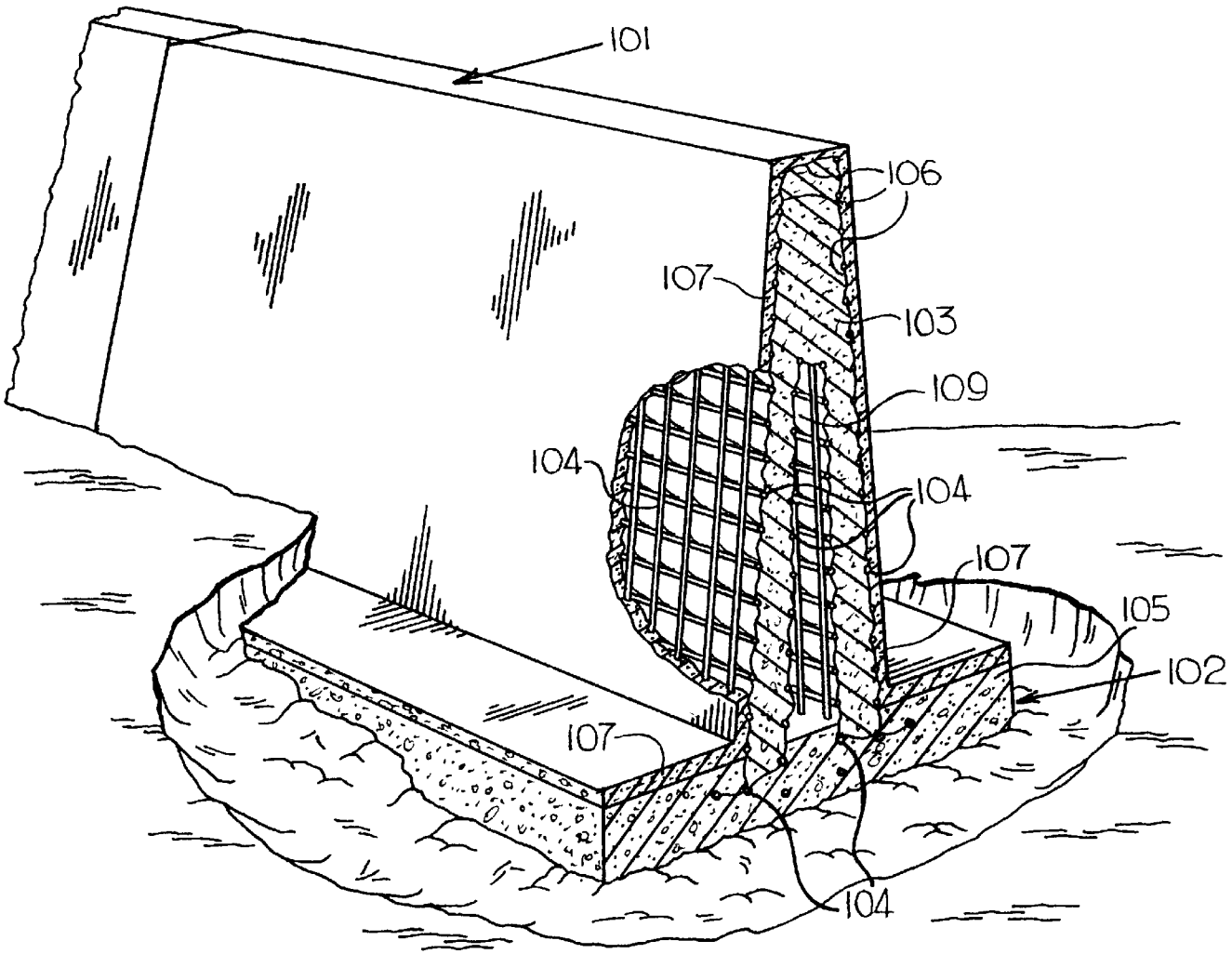
FIG. 4 shows an embodiment of the invention applied in a wall structure, shown in a broken away perspective view.

FIG. 4 shows two coupled wall structures 101 according to the invention. Each wall structure comprises a foundation base 102 placed in the ground and a standing wall panel 103 connected thereto.

The foundation base 102 has a width in transverse direction of the wall panel 103 which in this embodiment is roughly three times larger than the thickness of wall panel 103 in the zone adjoining foundation base 102.

The wall structure takes a monolithic form. It comprises mutually coupled steel gauze meshes designated 104 which are joined with a cured concrete mass 105. A plastic foil bag 106 is included inside the wall structure 101. This effectively prevents undesired washing away of material present in the concrete mass 105. Furthermore, a shotcrete plaster layer 107 is applied. The wall panel 103 has a cavity 109.

Figure 5:
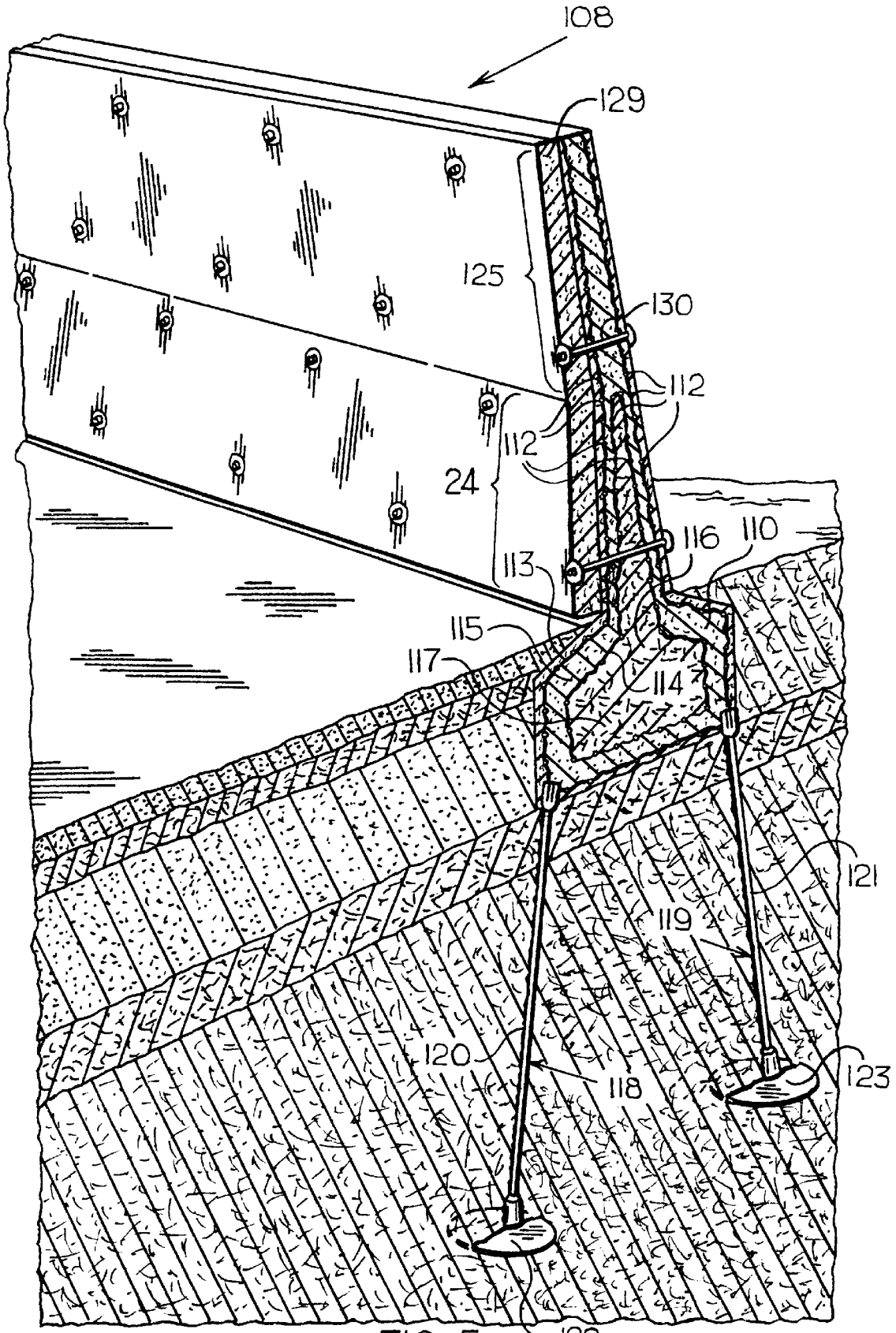
FIG. 5 is a view corresponding with FIG. 4 of a variant.

FIG. 5 shows a wall structure 108. This comprises a base 110 and a wall panel 111 formed integrally therewith. Wall structure 108 also comprises metal gauze meshes, which are all designated 112, and foil bags 113, 114. The space between foil bags 113, 114 is filled with a concrete mass 115 while an internal cavity 116 is filled with filler material 117 such as waste. At variance with the embodiment of FIG. 4, the stability of wall structure 108 is improved by making use of tie anchors 118, 119 consisting of tensively strong elements 120, 121 respectively connected to the base and anchor plates 122, 123 respectively anchored relatively deeply in the ground. Wall panel 111 comprises a lower part 124 standing substantially vertically straight and an upper part 125 connecting thereto at an angle of about 5".

Figure 6:
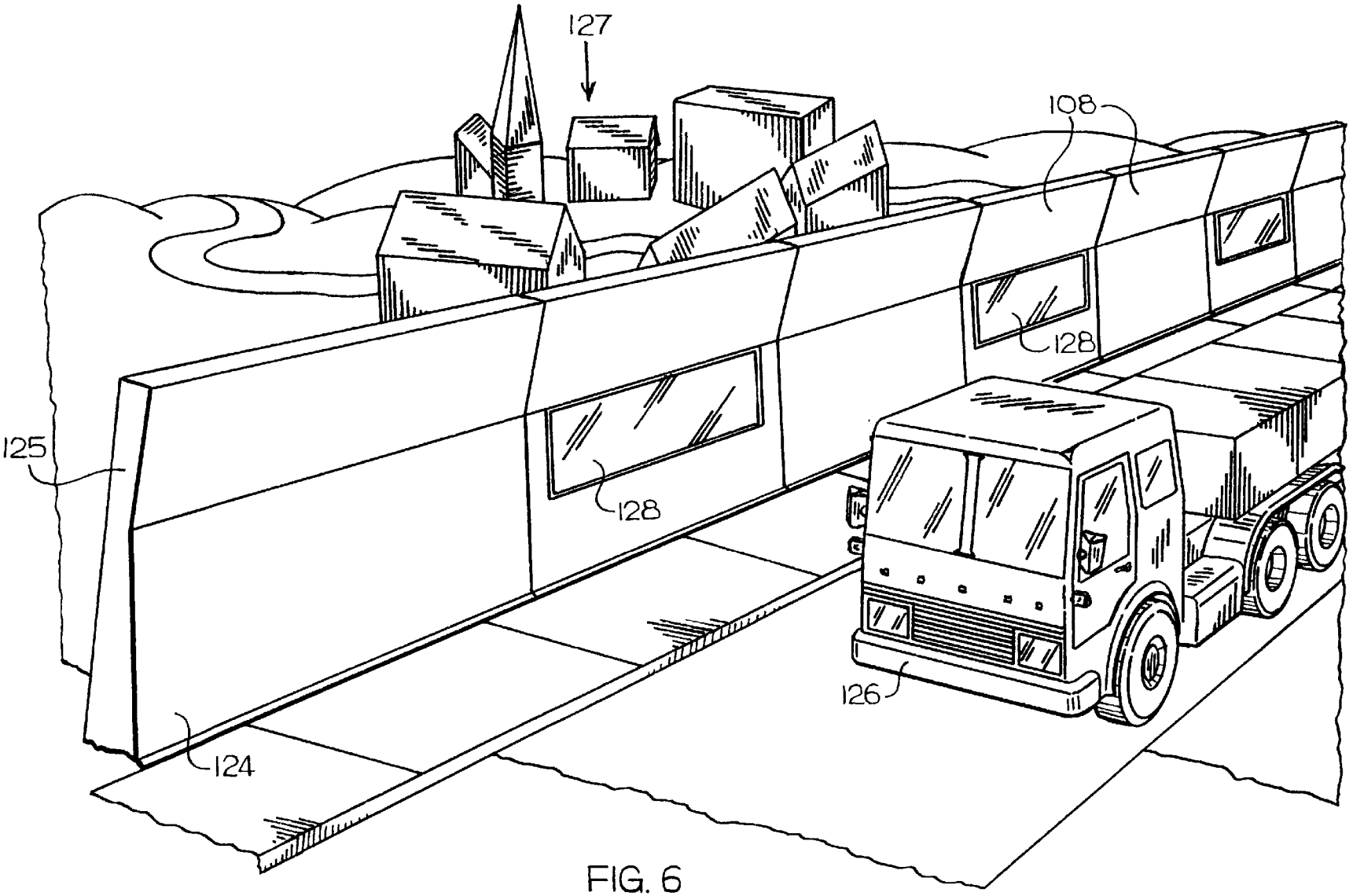
FIG. 6 shows a wall of modular construction consisting of modular units as according to FIG. 5.

FIG. 6 shows the use of the wall structures 108 as noise-protection wall. The upper parts 125 incline forward in the direction of the noise-producing traffic 126, whereby an effective reduction is realized in the sound emitted to the residential zone 127. Some wall structures 108 are provided with windows 128.

FIG. 5 shows that the noise-protection wall shown in FIG. 6 is provided with a sound-absorbing covering 129. This is coupled to the wall structure by means of fixing anchors 130.

Attention is drawn to the fact that the wall structures according to FIGS. 5 and 6 display a certain fold. The couplings between the gauze panels according to the invention are adapted to this shape. The joints of gauze panels at the drawn angles as shown in particular in FIG. 5 can be of the type shown in FIG. 1. The mutually registered hooks 14 are therein coupled by means of the rod 12.

Figure 7:
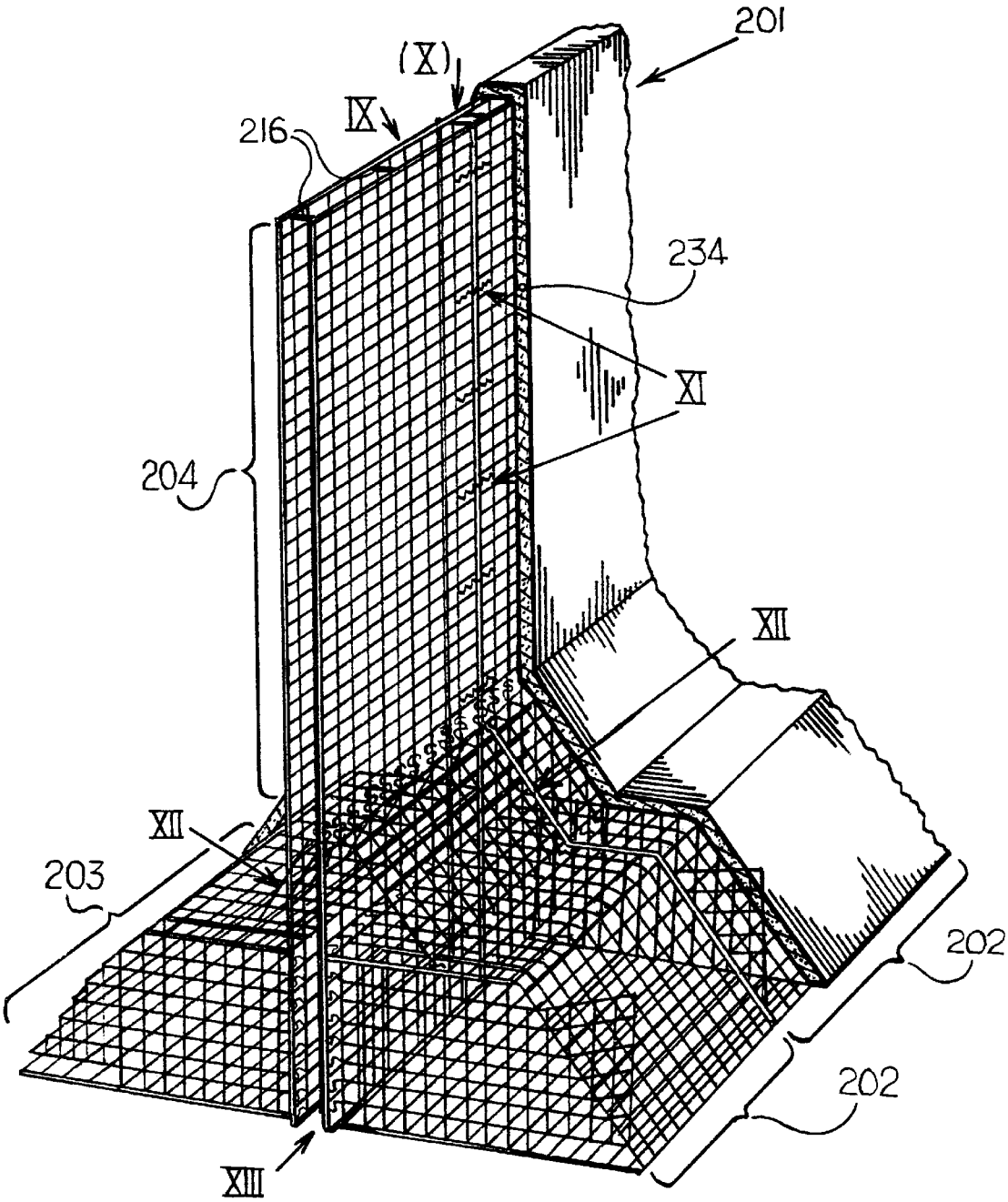
FIG. 7 shows a partly broken away perspective view of a noise-protection wall constructed on the basis of the invention.
Figure 8:
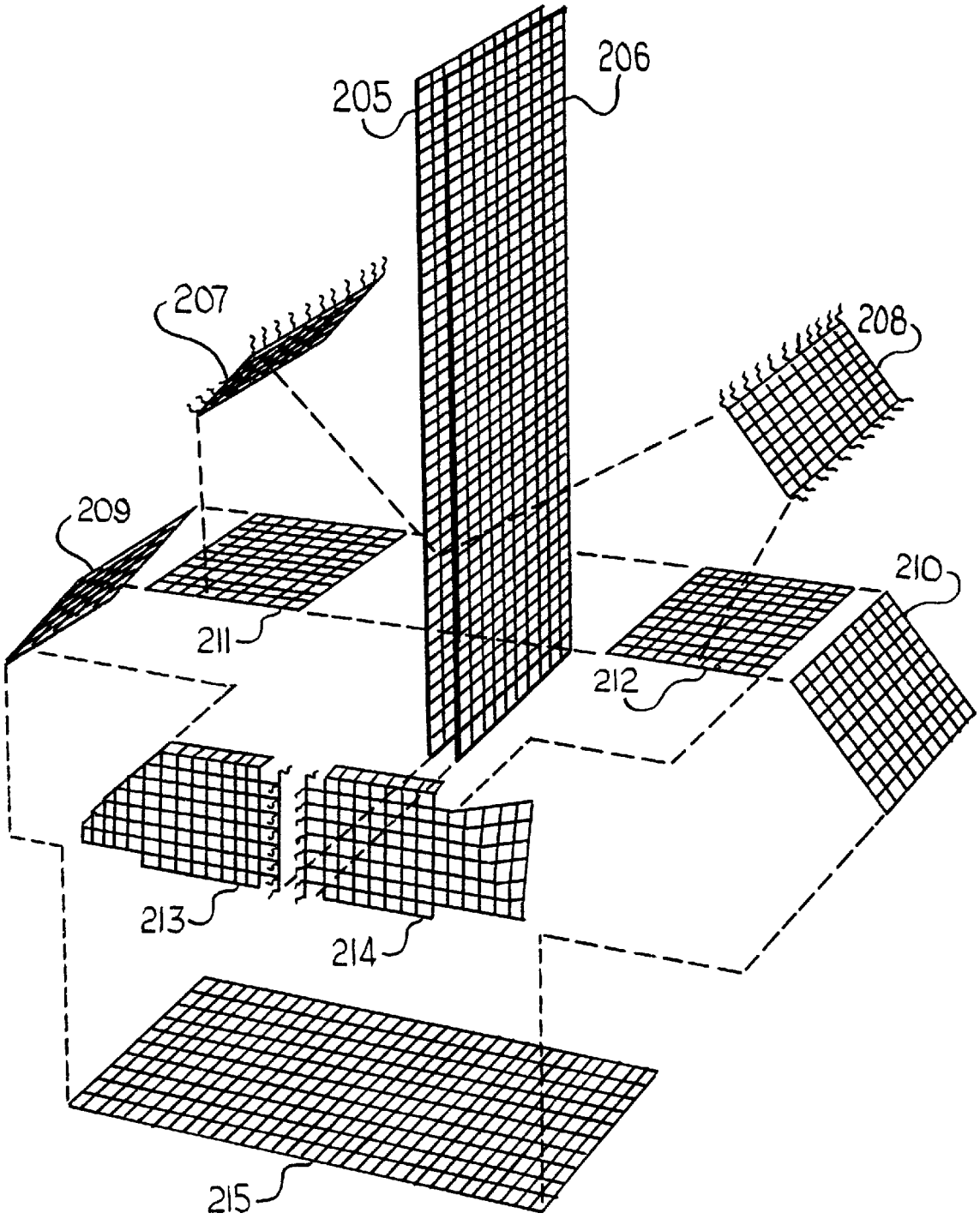
FIG. 8 is an exploded view of the gauze meshes from which a structural part of the noise-protection wall according to FIG. 7 is constructed.

FIG. 7 shows a noise-protection wall 201 having noise protection wall parts 202. These are constructed on the basis of the coupling according to the invention. The reference numerals IX, X, XI, XII and XIII refer respectively to the FIGS. 9, 10, 11, 12 and 13. The noise-protection wall 201 has by and large the same construction as that wall structure 101 as according to FIG. 4. It contains a foundation base 203 and an up-right wall part 204. As shown in FIG. 8, the parts 202 are constructed on the basis of a plurality of gauze meshes 205, 206, 207, 208, 209, 210, 211, 212, 213, 214, 215.

Figure 9:
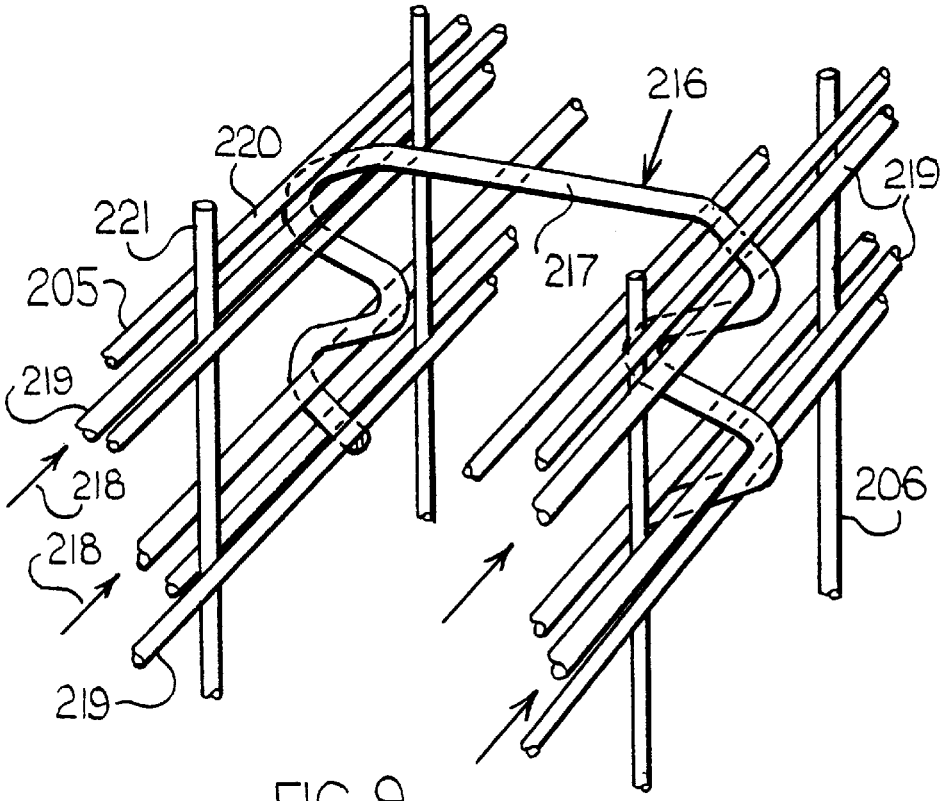
FIG. 9 is a partly perspective view of a coupling between three structural elements, wherein an intermediate element is coupled to two other elements.

FIG. 9 shows the detail IX on enlarged scale. The gauze meshes 205 and 206 are coupled and held at mutual distance by means of a spacer element 216 which, as the gauze meshes 205–215, is made up of concrete reinforcing rod material. It comprises a plurality of substantially horizontally extending rods to which is welded a bracket 217 which has a substantially W-shaped structure on both sides. In the manner shown in FIG. 4 the spacer elements 216 are coupled via the brackets 217 by means of rods 219 inserted as according to arrows 218.

Figure 10:
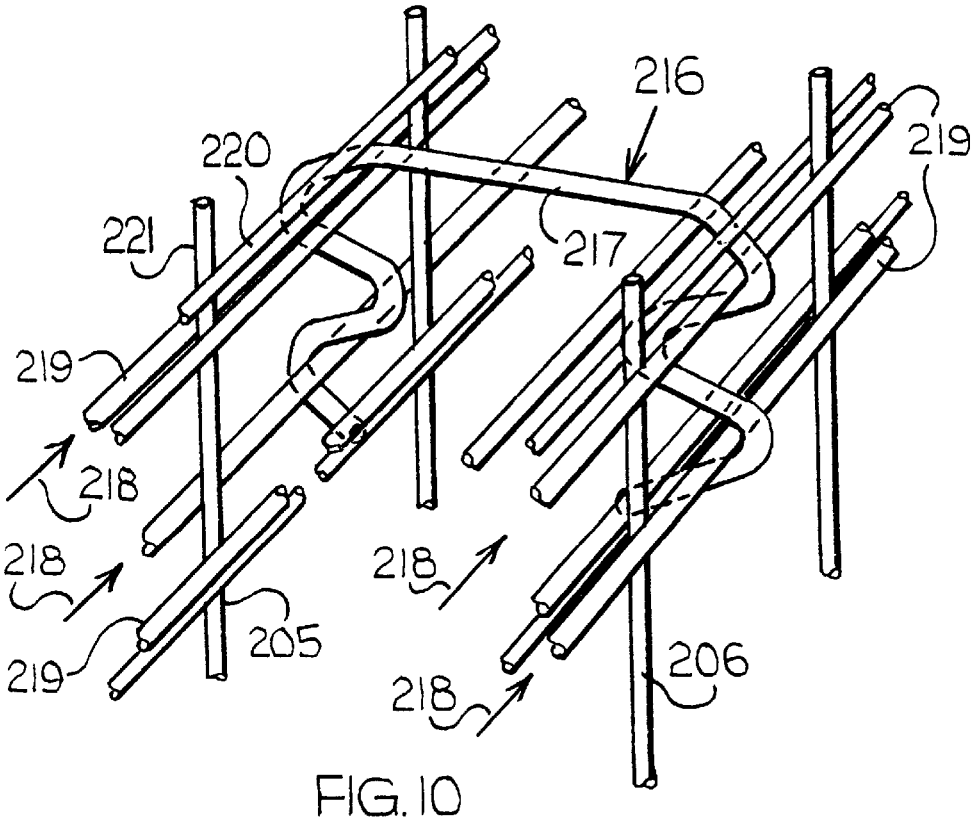
FIG. 10 is a view corresponding with FIG. 9 of a variant.

The structure of FIG. 10 has a function similar to the structure of FIG. 9. In this embodiment the horizontal rods 220' are situated on the inside relative to the vertical rods 221', while the corresponding rods 220 of FIG. 9 are situated on the outside relative to the vertical rods 221

Figure 11:
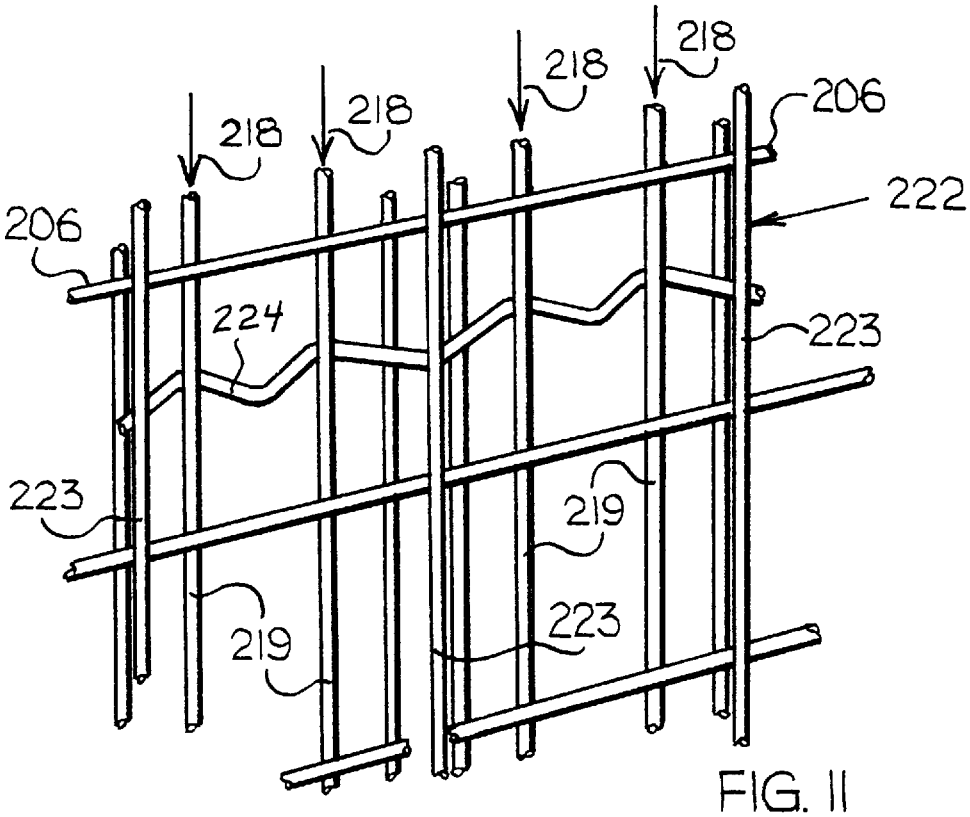
FIG. 11 is a partly perspective view of yet another embodiment

FIG. 11 shows the coupling between two adjoining gauze meshes, both designated with 206. Use is made of a coupling element 222 which comprises a plurality of vertical rods 223 mutually connected by brackets 224 ben generally in a W-shape. As shown clearly in FIG. 11, use is also made here of coupling rods 219 inserted as according to arrows 218.

Figure 12:
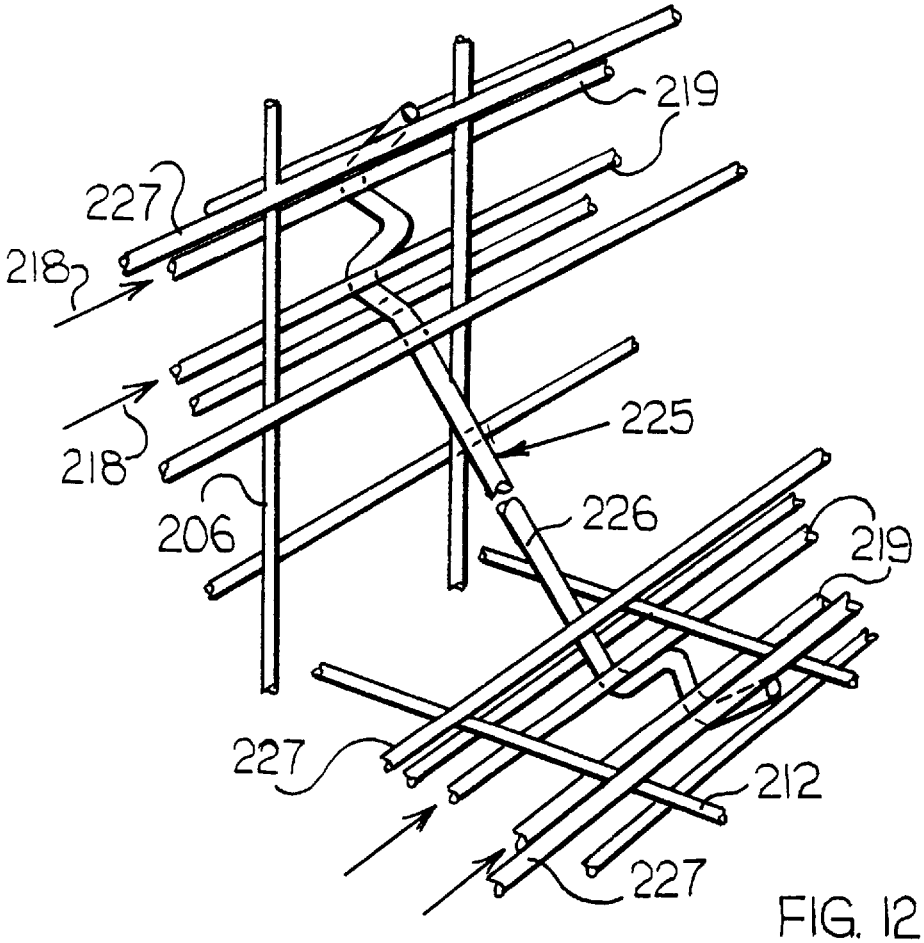
FIG. 12 is a partly perspective view of a subsequent alternative.

FIG. 12 shows the coupling between gauze meshes 206 and 212. These gauze meshes are coupled in the manner indicated in FIG. 12 by means of a coupling element 225 with horizontal rods 227 which are mutually connected by a bracket 226 and which are connected by coupling rods 219 via the W-shaped ends of the brackets 226.

Figure 13:
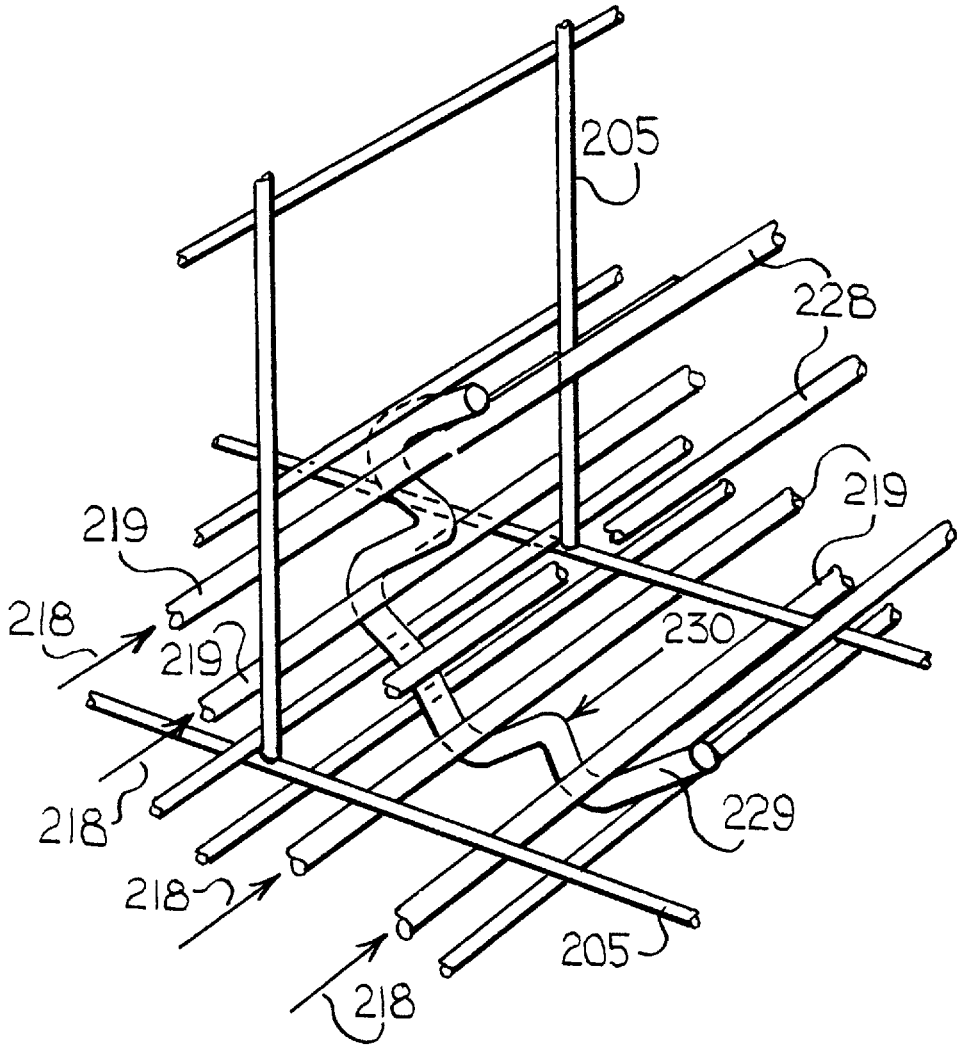
FIG. 13 is a partly perspective view of a final embodiment.

FIG. 13 shows the coupling between the gauze meshes 215 and 205. Use is also made here of a coupling element 230 consisting of horizontal rods 228 with coupling brackets 229 The brackets 229 here also comprise generally W-shaped end zones which serve for coupling making use of coupling rods 219.

Figure 14:
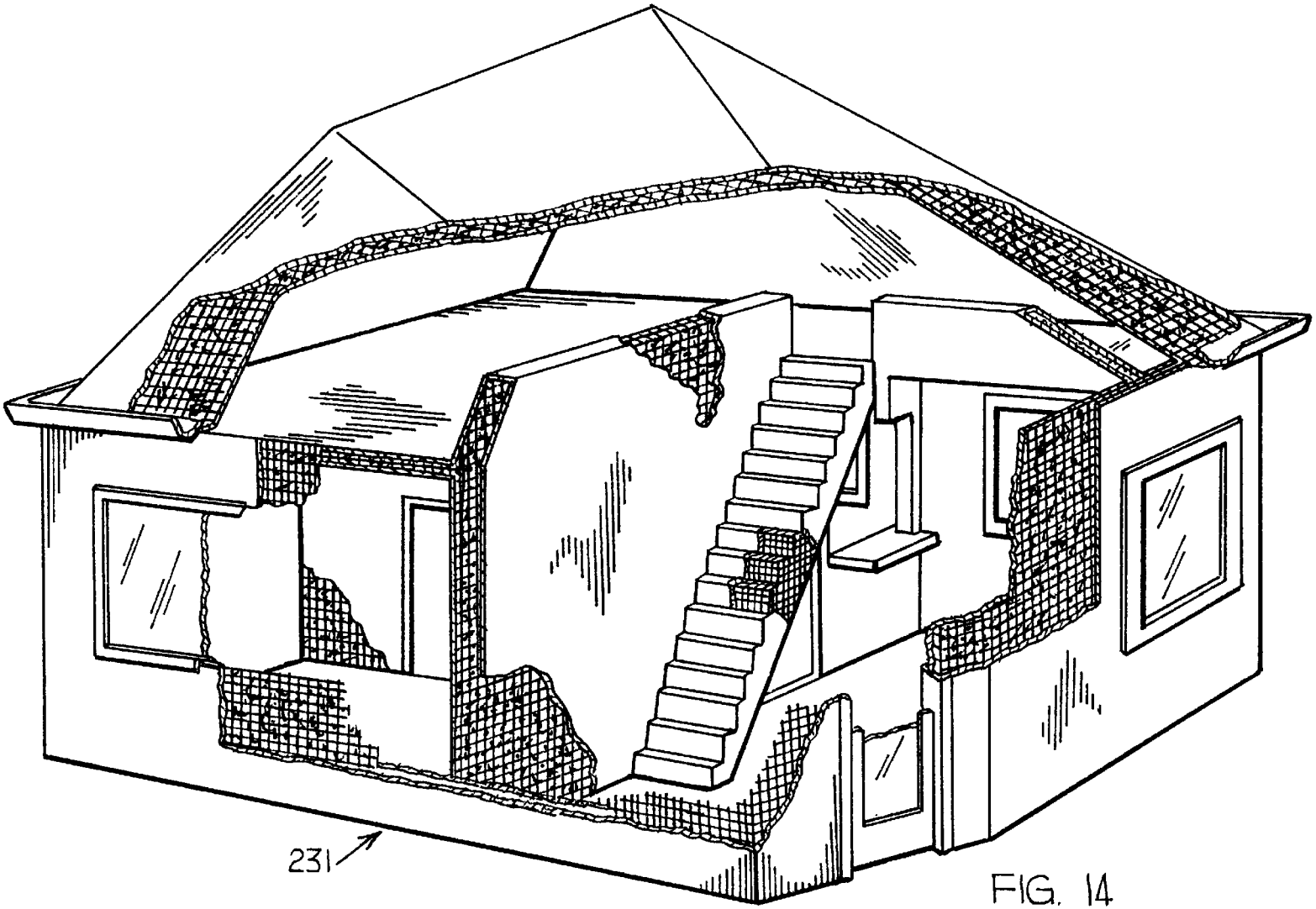
FIG. 14 shows a partly broken away perspective view of a house built making use of couplings according to the invention.

FIG. 14 shows a house 231 constructed predominantly on the basis of structural elements which are mutually coupled with application of the coupling according to the invention. It will be apparent from this FIG. 14 that the spatial structures which can be realized with the invention can be relatively complicated with use of essentially very simple means.

Figure 15:
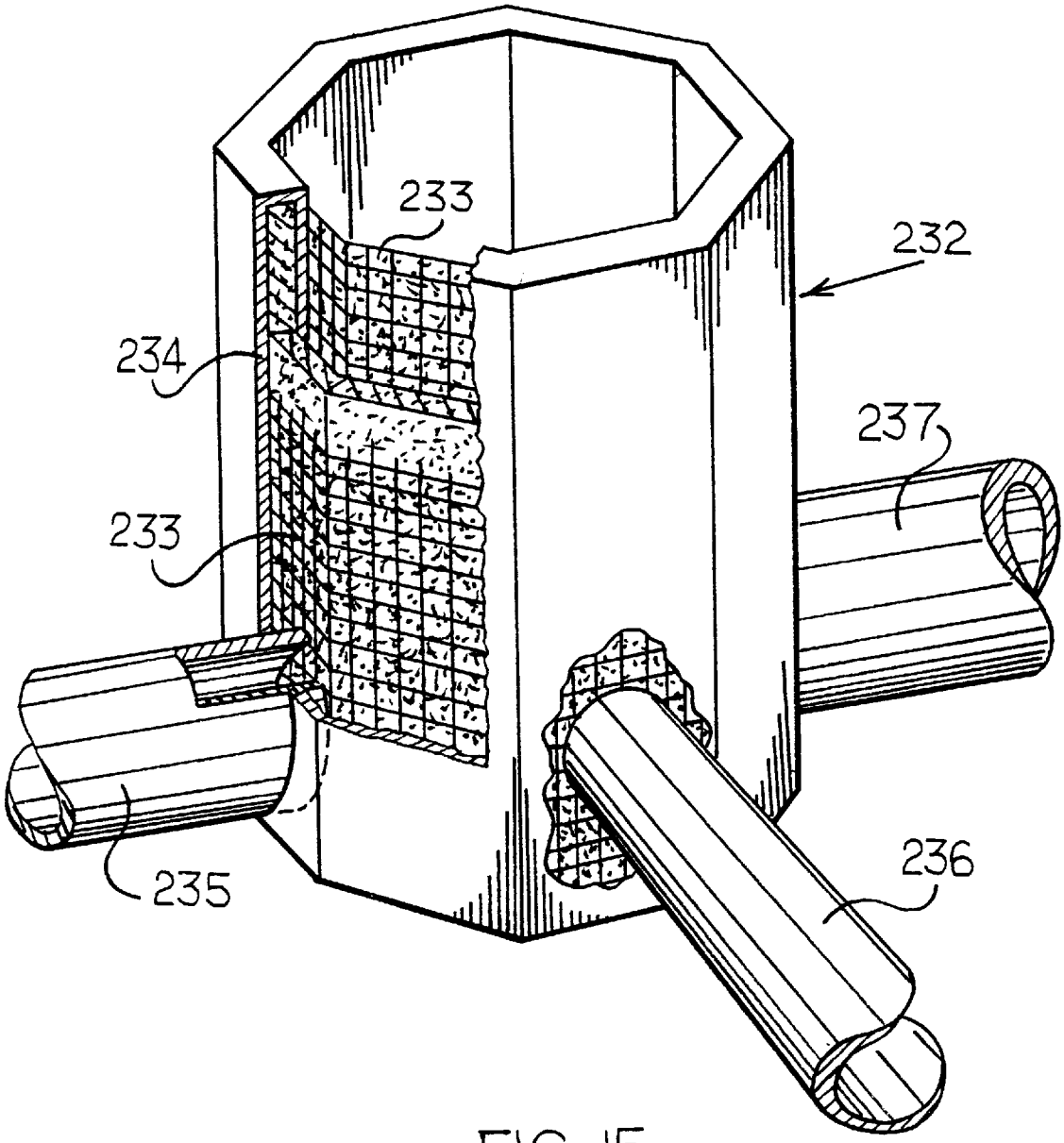
FIG. 15 shows a partly broken away perspective view of a catch pit constructed on the basis of the coupling according to the invention.

FIG. 15 shows a catch pit 232 consisting substantially of reinforced concrete. The reinforcement consists of eight gauze meshes 233 which are combined into a regular polygonal prismatic shape and which are mutually coupled according to the invention. The obtained structure forms the reinforcement of concrete cast therearound which is finished with a plaster layer 234 similar to the plaster layer 234 with which the noise-protection wall parts 202 of FIG. 7 are covered.

Pipes 235, 236, 237 connect onto the catch pit 232. This coupling can be effected by interrupting the meshes 233 local or in advance and connecting the pipes liquid-tight to the catch pit 232 in per se known manner.

I claim:

1. A wall structure, comprising:

a first spatial structure;

a second spatial structure spaced away from the first spatial structure, the first spatial structure and the second spatial structure defining an internal space therebetween, the first spatial structure and the second spatial structure each including:

a plurality of gauze meshes, each of the gauze meshes having at least one integrally formed coupling part, wherein the coupling parts of each of the gauze meshes are registered in interlaced relation in the interspaces of an adjacent gauze mesh, and the coupling parts are mutually coupled in the interlaced and registered situation by an elongate coupling element; and a first plastic foil bag located in the internal space and conforming to the gauze meshes of the first spatial structure and the second spatial structure to define an enclosed internal space in which a concrete filler mass is present, and the concrete filler mass is restrained within the enclosed internal space during curing by the first plastic foil bag and the gauze meshes.

2. The wall structure according to claim 1, wherein a second plastic foil bag is accommodated in the enclosed internal space bounded by the first plastic foil bag, the second foil bag being filled with filler material.

3. The wall structure as claimed in claim 2, wherein the filler material is concrete.

4. The wall structure as claimed in claim 2, wherein the filler material is waste material.

5. A wall structure, comprising:

a) a first spatial structure;

b) a second spatial structure spaced apart from the first spatial structure, the first spatial structure and the second spatial structure defining an internal space therebetween, the first spatial structure and the second spatial structure each including:

a plurality of structural elements;

at least one coupling element, the structural elements each mutually coupled to an adjacent structural element with the at least one coupling element, the at least one coupling element registered in interlaced relation between the adjacent structural elements; and at least one elongate element co-acting with the at least one coupling element such that the adjacent structural elements are mutually coupled together;

c) at least one spacer element connecting the first spatial structure to the second spatial structure such that the first spatial structure and the second spatial structure are held a fixed distance apart; and d) a first foil bag positioned in the internal space and conforming to the structural elements of the first spatial structure and the second spatial structure to define an enclosed internal space in the wall structure, wherein concrete is located in the enclosed internal space, and the concrete is restrained within the enclosed internal space during curing by the first foil bag and the structural elements.

6. The wall structure as claimed in claim 5, wherein the structural elements each include a plurality of horizontal rods connected to a plurality of vertical rods, the horizontal rods and the vertical rods ordered in grid form.

7. The wall structure as claimed in claim 6, wherein the at least one coupling element is formed as a hook-like protrusion extending from at least one end of the horizontal rods of the structural elements for engaging the horizontal rods and the vertical rods of the adjacent structural element.

8. The wall structure as claimed in claim 5, further including a second foil bag positioned within the enclosed internal space bounded by the first foil bag and defining a cavity, the cavity filled with a filler material.

9. The wall structure as claimed in claim 8, wherein the filler material is concrete.

10. The wall structure as claimed in claim 8, wherein the filler material is waste material.

11. The wall structure as claimed in claim 5, further including an outer layer of shotcrete plaster.

12. The wall structure as claimed in claim 5, further including a sound-absorbing outer layer such that the wall structure is a noise protection wall.

13. The wall structure as claimed in claim 12, further including windows provided in the wall structure.

14. The wall structure as claimed in claim 8, wherein the first foil bag and the second foil bag are made of plastic.

15. The wall structure as claimed in claim 5, wherein the structural elements, the at least one coupling element, the at least one elongate element and the at least one spacer element are made of a material selected from the group consisting of steel, concrete, glass fiber and fiber reinforced polymers.

16. The wall structure as claimed in claim 5, wherein the first spatial structure and the second spatial structure are joined to a foundation slab of concrete.

17. A wall structure, comprising:

a) a first spatial structure;

b) a second spatial structure spaced apart from the first spatial structure, the first spatial structure and the second spatial structure defining an internal space therebetween, the first spatial structure and the second spatial structure each including:

a plurality of structural elements each having a plurality of horizontal rods connected to a plurality of vertical rods, the horizontal rods and the vertical rods ordered in grid form;

at least one coupling element, the structural elements each mutually coupled to an adjacent structural element with the at least one coupling element, the at least one coupling element registered in interlaced relation between the adjacent structural elements; and at least one elongate element co-acting with the at least one coupling element such that the adjacent structural elements are mutually coupled together;

c) at least one spacer element connecting the first spatial structure to the second spatial structure such that the first spatial structure and the second spatial structure are held a fixed distance apart;

d) a first plastic foil bag positioned in the internal space and conforming to the structural elements of the first spatial structure and the second spatial structure to define an enclosed internal space in the wall structure; and e) an outer layer of plaster on the first spatial structure and the second spatial structure, wherein concrete is located in the enclosed internal space, and the concrete is restrained within the enclosed internal space during curing by the first plastic foil bag and the structural elements.

18. The wall structure as claimed in claim 17, further including a second plastic foil bag positioned within the enclosed internal space bounded by the first plastic foil bag and defining a cavity within the wall structure, the cavity filled with a filler material.

19. The wall structure as claimed in claim 17, wherein the outer layer of plaster is sound-absorbing such that the wall structure is a noise protection wall.

20. The wall structure as claimed in claim 17, wherein the first spatial structure and the second spatial structure are joined to a foundation slab of concrete.

* * * * *